US011191409B2

(12) United States Patent
Carl

(10) Patent No.: US 11,191,409 B2
(45) **Date of Patent: *Dec. 7, 2021**

(54) ERGONOMIC GRIPPING MECHANISMS OF A HANDHELD AIR MOVEMENT APPARATUS

(71) Applicant: Transform SR Brands LLC, Hoffman Estates, IL (US)

(72) Inventor: Ross Carl, River Forest, IL (US)

(73) Assignee: TRANSFORM SR BRANDS LLC, Hoffman Estates, IL (US)

( * ) Notice: Subject to any disclaimer, the term of this patent is extended or adjusted under 35 U.S.C. 154(b) by 322 days.

This patent is subject to a terminal disclaimer.

(21) Appl. No.: 16/415,608

(22) Filed: May 17, 2019

(65) Prior Publication Data

US 2020/0037840 A1 Feb. 6, 2020

Related U.S. Application Data

(63) Continuation of application No. 15/486,130, filed on Apr. 12, 2017, now Pat. No. 10,292,559.
(Continued)

(51) Int. Cl.
*A47L 9/32* (2006.01)
*A47L 5/24* (2006.01)
(Continued)

(52) U.S. Cl.
CPC ..... *A47L 9/322* (2013.01); *A47L 5/24* (2013.01); *A47L 9/0081* (2013.01); *A47L 9/2857* (2013.01); *A47L 9/2884* (2013.01)

(58) Field of Classification Search
CPC ..... A47L 9/322; A47L 5/24; A47L 9/0081; A47L 9/2857; A47L 9/2884; A47L 5/14; A47L 5/225; A47L 9/1427; A47L 9/2889
See application file for complete search history.

(56) References Cited

U.S. PATENT DOCUMENTS 5,083,340 A 1/1992 Takahashi et al.
5,996,175 A 12/1999 Fusco
(Continued)

OTHER PUBLICATIONS

PCT International Search Report and Written Opinion for International Application No. PCT/US17/27581, filing date Apr. 14, 2017, dated Jul. 14, 2017, 12 pages.

*Primary Examiner* — Dung Van Nguyen
(74) *Attorney, Agent, or Firm* — McAndrews, Held & Malloy, Ltd.

(57) ABSTRACT

Ergonomic gripping mechanisms of handheld air movement apparatuses are provided. A handheld air movement apparatus may include a handle portion and a tool portion. The handle portion may include a grip, a trigger, and a handle pivot. The grip may have first and second ends. The trigger may be positioned toward the first end of the grip and the handle pivot may be positioned toward the second end of the grip. The tool portion may include a housing, a nozzle coupled to the housing, and a handle connection base. The tool portion may provide air movement into and/or out of the nozzle in response to a signal received from the trigger of the handle portion. The handle connection base of the tool portion may be pivotally coupled to the handle portion at the handle pivot to provide directional height adjustment of the tool portion with respect to the handle portion.

19 Claims, 5 Drawing Sheets

Related U.S. Application Data

(60) Provisional application No. 62/323,067, filed on Apr. 15, 2016.

(51) Int. Cl.
*A47L 9/28* (2006.01)
*A47L 9/00* (2006.01)

(56) References Cited

U.S. PATENT DOCUMENTS

| | | | | |
|---|---|---|---|---|
| 10,292,559 | B2 * | 5/2019 | Carl | A47L 9/2884 |
| 2005/0081321 | A1 | 4/2005 | Milligan | |
| 2007/0033765 | A1 | 2/2007 | Walker | |
| 2011/0219557 | A1 | 9/2011 | Rosenzweig et al. | |
| 2014/0331444 | A1 | 11/2014 | Nesom et al. | |
| 2014/0373305 | A1 | 12/2014 | Lee | |
| 2016/0157686 | A1 | 6/2016 | Bermudez et al. | |
| 2016/0324292 | A1 | 11/2016 | Depoyian | |

* cited by examiner

ERGONOMIC GRIPPING MECHANISMS OF A HANDHELD AIR MOVEMENT APPARATUS

CROSS-REFERENCE TO RELATED APPLICATIONS/INCORPORATION BY REFERENCE

The present application is a continuation of U.S. patent application Ser. No. 15/486,130, filed on Apr. 12, 2017, now U.S. Pat. No. 10,292,559, which claims priority under 35 U.S.C. § 119(e) to provisional application Ser. No. 62/323,067, filed on Apr. 15, 2016. The above referenced applications are hereby incorporated herein by reference in their entirety.

FEDERALLY SPONSORED RESEARCH OR DEVELOPMENT

[Not Applicable]

MICROFICHE/COPYRIGHT REFERENCE

[Not Applicable]

FIELD

Certain embodiments relate to handheld air movement apparatuses. More specifically, certain embodiments provide ergonomic gripping mechanisms of handheld air movement apparatuses, such as handheld leaf blowers and/or vacuums. The ergonomic gripping mechanisms provide enhanced efficacy of the handheld air movement apparatus while providing a more natural grip position and improved weight distribution by, among other things, incorporating directional height adjustment to position a nozzle of the apparatus nearer its target.

BACKGROUND

Handheld air movement apparatuses, such as leaf blowers and/or vacuums, typically include a fixed handle for grasping by a user of the tool. The user maneuvers the handheld air movement apparatus to direct the nozzle of the tool by twisting the user's wrist, which may result in an unnatural, unbalanced, and/or uncomfortable grip position. Existing handheld air movement apparatuses typically have limited, if any, adjustable features to provide a natural grip orientation.

Further limitations and disadvantages of conventional and traditional approaches will become apparent to one of skill in the art, through comparison of such systems with some aspects of the present disclosure as set forth in the remainder of the present application with reference to the drawings.

BRIEF SUMMARY

Ergonomic gripping mechanisms of handheld air movement apparatuses are provided, substantially as shown in and/or described in connection with at least one of the figures, as set forth more completely in the claims.

These and other advantages, aspects and novel features of the present disclosure, as well as details of an illustrated embodiment thereof, will be more fully understood from the following description and drawings.

DETAILED DESCRIPTION

Certain embodiments may be found in ergonomic gripping mechanisms 120 of handheld air movement apparatuses 100. More specifically, certain embodiments provide ergonomic gripping mechanisms 120 that provide enhanced efficacy of the handheld air movement apparatus while providing a more natural grip position and improved weight distribution by, among other things, incorporating directional height adjustment to position a nozzle of the apparatus nearer its target.

As used herein, an element recited in the singular and proceeded with the word "a" or "an" should be understood as not excluding the plural of the elements, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Although certain embodiments in the foregoing description may be shown with a battery-powered apparatus, for example, unless so claimed, the scope of various aspects of the present disclosure should not be limited to battery-powered tools and may additionally and/or alternatively be applicable to any suitable powered tools, such as gas-powered tools, electric powered tools, and the like. Moreover, although certain embodiments in the foregoing description may be shown as a handheld leaf blower, for example, unless so claimed, the scope of various aspects of the present disclosure should not be limited to leaf blowers and may additionally and/or alternatively be applicable to any suitable handheld air movement apparatus, such as handheld vacuum tools, and the like.

Figure 1:
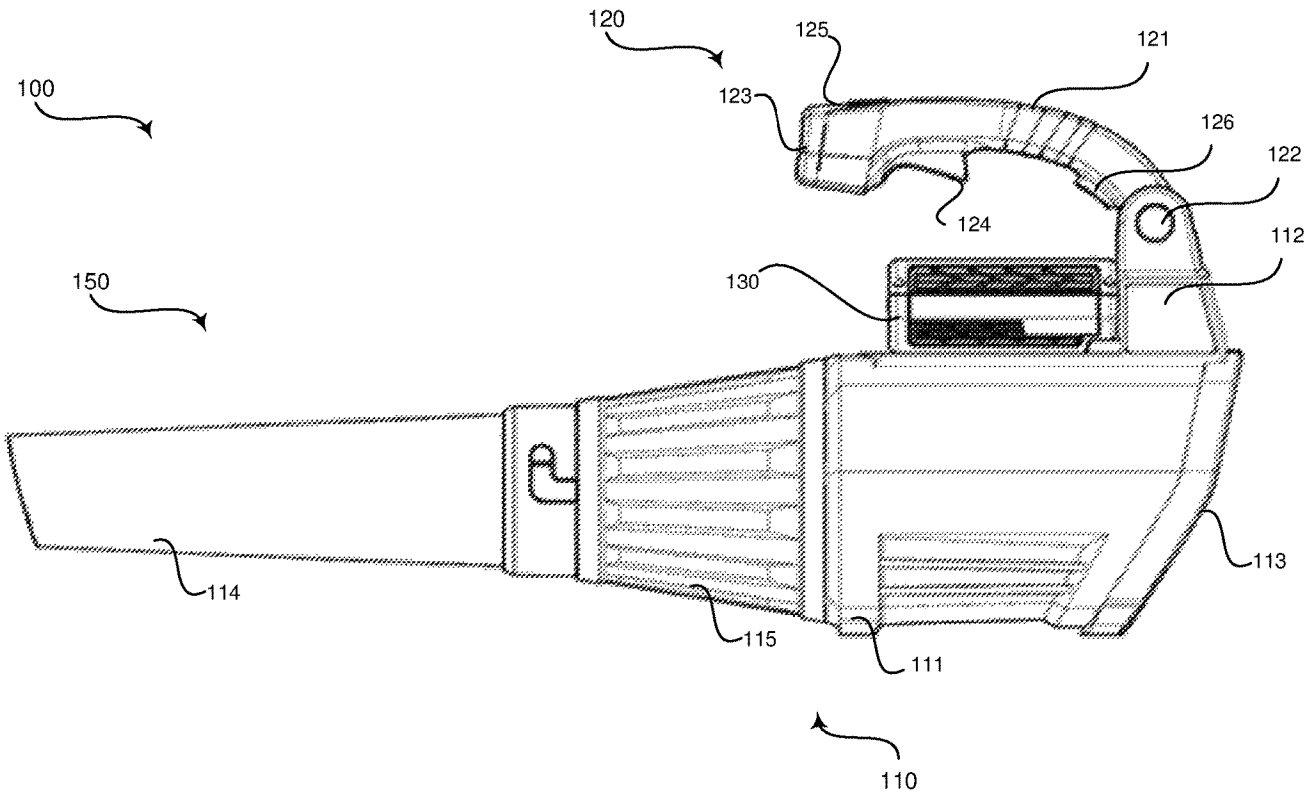
FIG. 1 is a side view of an exemplary handheld air movement apparatus in a first position, the apparatus having ergonomic gripping mechanisms, in accordance with various embodiments.
Figure 2:
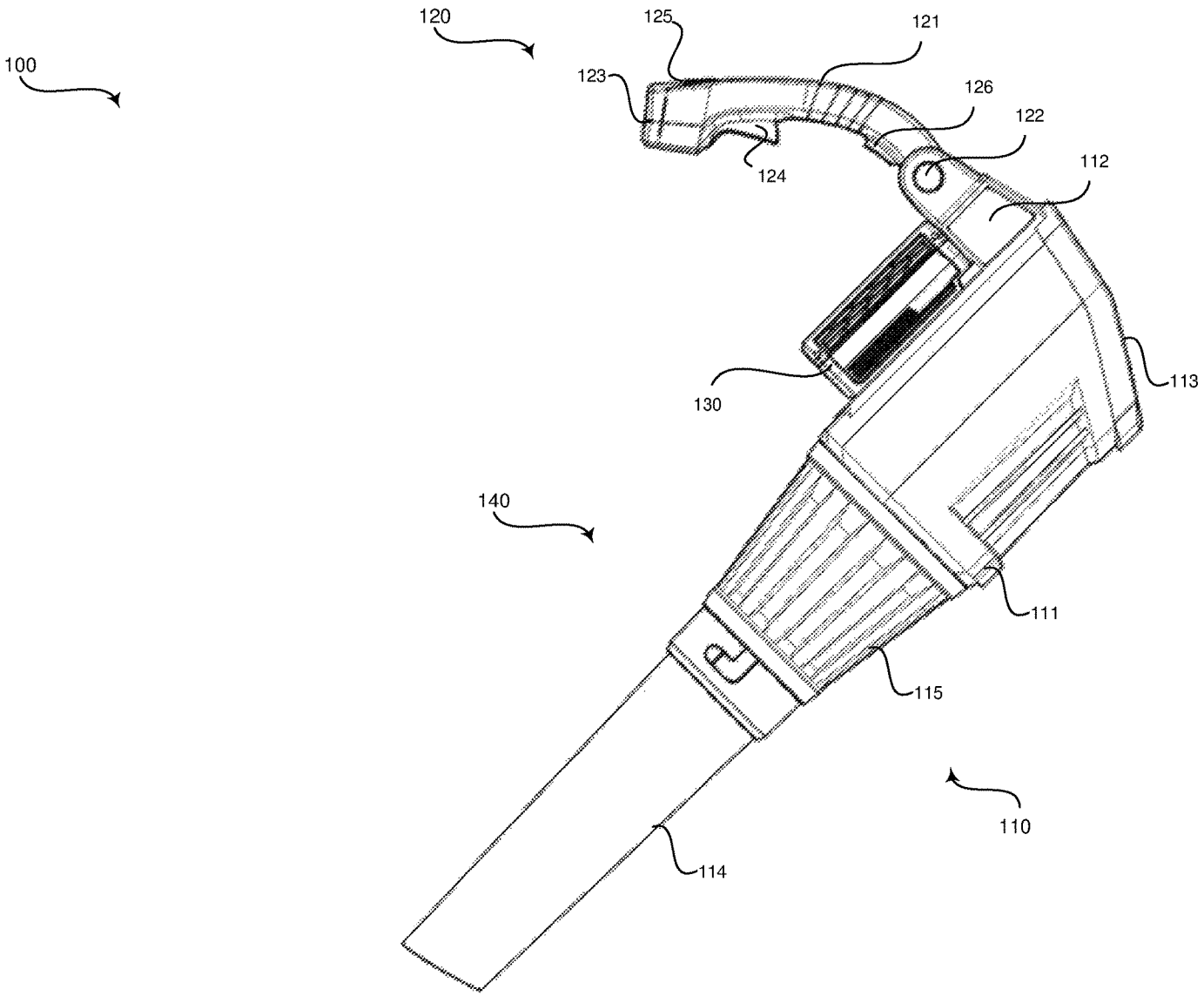
FIG. 2 is a side view of an exemplary handheld air movement apparatus in a second position, the apparatus having ergonomic gripping mechanisms, in accordance with various embodiments.
Figure 3:
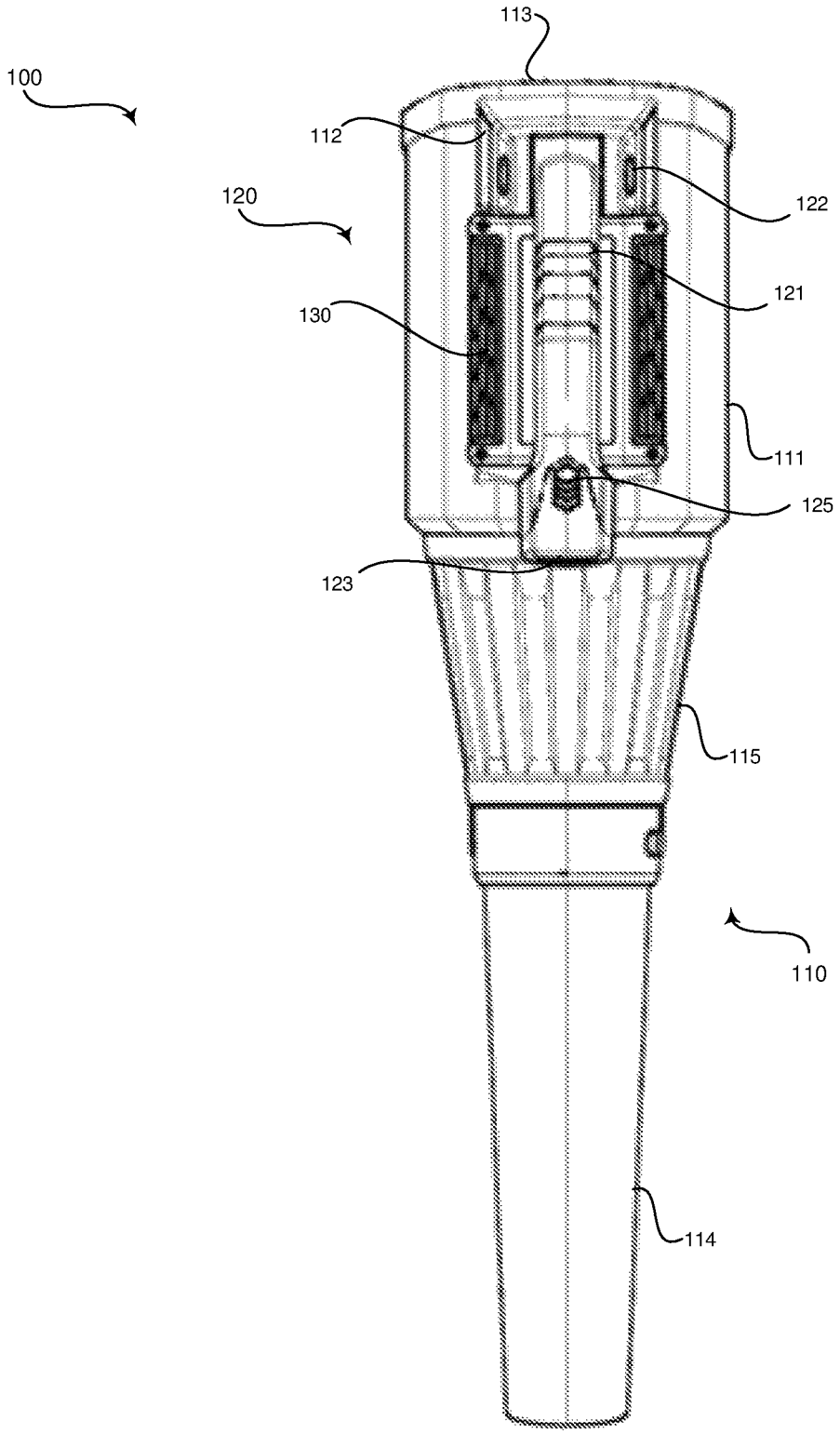
FIG. 3 is a top view of an exemplary handheld air movement apparatus having ergonomic gripping mechanisms, in accordance with various embodiments.
Figure 4:
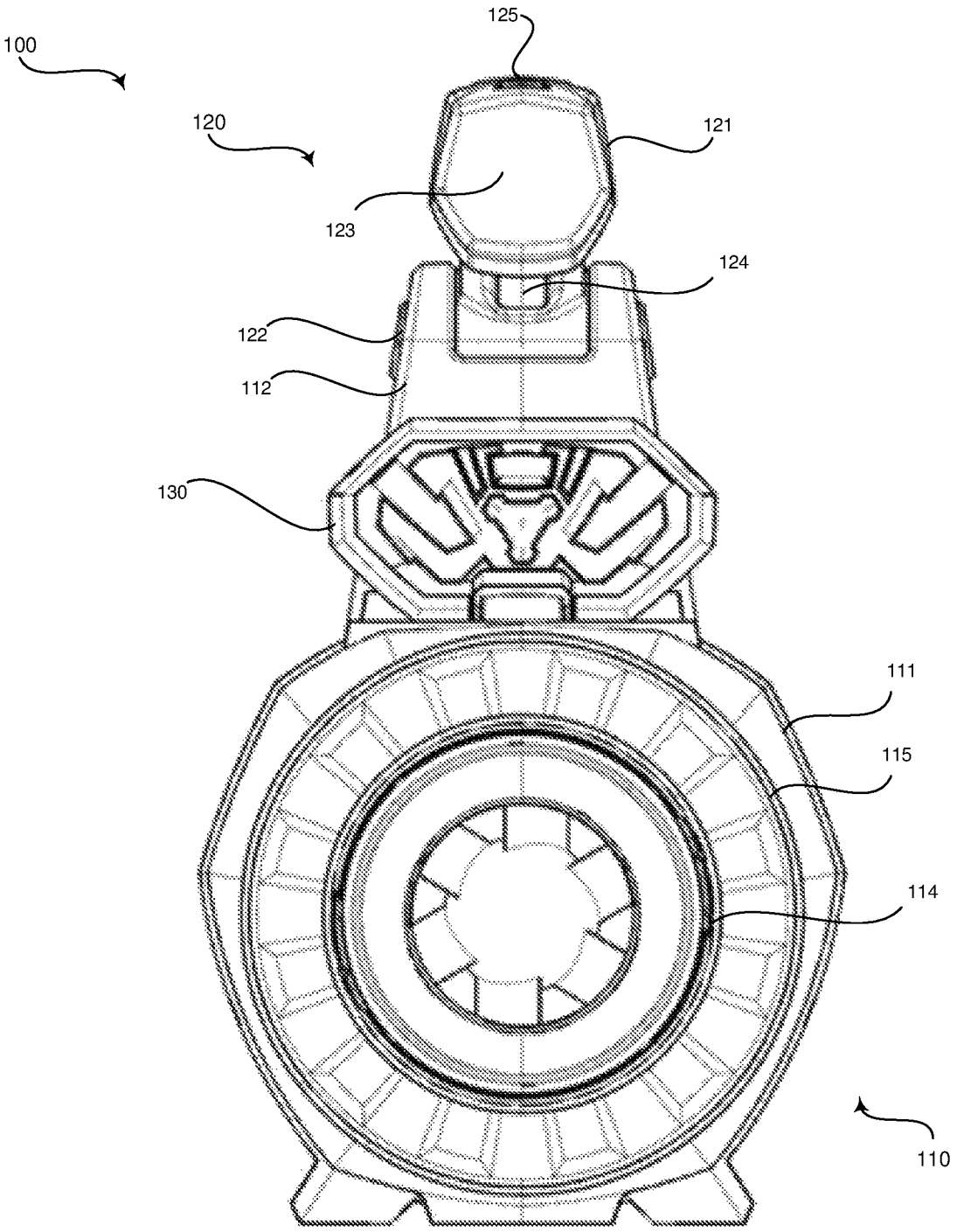
FIG. 4 is a front view of an exemplary handheld air movement apparatus having ergonomic gripping mechanisms, in accordance with various embodiments.
Figure 5:
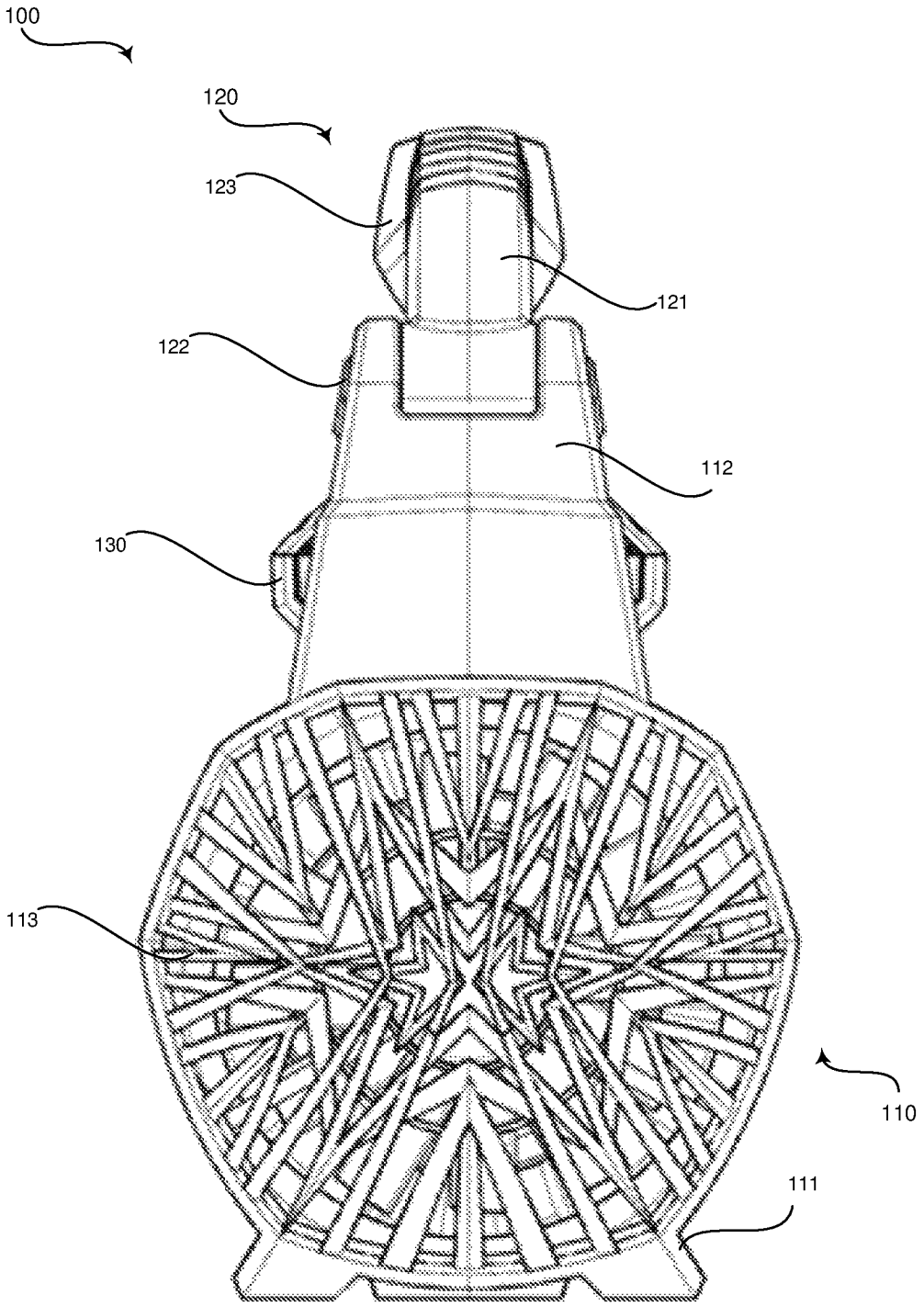
FIG. 5 is a rear view of an exemplary handheld air movement apparatus having ergonomic gripping mechanisms, in accordance with various embodiments.

FIG. 1 is a side view of an exemplary handheld air movement apparatus 100 in a first position 150, the apparatus 100 having ergonomic gripping mechanisms 120, in accordance with various embodiments. FIG. 2 is a side view of an exemplary handheld air movement apparatus 100 in a second position 140, the apparatus 100 having ergonomic gripping mechanisms 120. FIG. 3 is a top view of an exemplary handheld air movement apparatus 100 having ergonomic gripping mechanisms 120. FIG. 4 is a front view of an exemplary handheld air movement apparatus 100 having ergonomic gripping mechanisms 120. FIG. 5 is a rear view of an exemplary handheld air movement apparatus 100 having ergonomic gripping mechanisms 120. Referring to FIGS. 1-5, the handheld air movement apparatus 100 comprises a tool portion 110 and a handle portion 120. The tool portion 110 may comprise a housing 111, 115, a handle connection base 112, a fan opening 113, and a nozzle 114. The tool portion 110 may include or be attached to a power source, such as a battery 130, gas, or electrical power source.

The housing 111, 115 may be a hollow portion having a motor and fan(s), among other things, disposed therein. The motor may be battery-powered, gas-powered, electric-powered, or the like. The fan(s) may include, for example, one or more fans for: (1) cooling the motor (e.g., cooling fan), (2) blowing air pulled into the housing 111, 115 through the fan opening 113 and out the nozzle 114 (e.g., blower operation of the apparatus 100), and/or (3) pulling air into the housing 111, 115 and/or a disposal bag (not shown) from the nozzle 114 (e.g., vacuum operation of the apparatus 100). The housing 111, 115 may be a hard plastic or any suitable material(s). The housing 111, 115 may include an upper portion 111 and a lower portion 115. The lower portion 115 may couple with the nozzle 114 on a first end and the upper portion 111 on a second end. In various embodiments, the lower portion 115 may be tapered such that the first end has a narrower diameter than the second end. In certain embodiments, the upper portion 111 and lower portion 115 of the housing may be detachably coupled, fixably coupled, or integrated as a single piece, among other things. The upper portion 111 may comprise a first end, second end, top side, and underside. The first end of the upper portion 111 may couple to the second end of the lower portion 115. The second end of the upper portion 111 may comprise the fan opening 113. The top side of the upper housing 111 may include a handle connection base 112 configured to pivotally attach with the handle portion 120 at a handle pivot 122 as described below.

In various embodiments, the top side of the upper portion 111 may include electrical connections and an attachment mechanism for receiving a battery 130. Additionally and/or alternatively, the electrical connections and attachment mechanism for the battery 130 may be placed in any suitable position on or in the tool portion housing 111, 115. The attachment mechanism may be grooves configured to slidably receive ridges in a battery 130, or any suitable attachment mechanism. In various embodiments, the apparatus 100 may be configured with an enclosure-free battery 130. For example, the battery 130 may snap, slide, or otherwise directly and securely connect with the electrical connections on the tool portion housing 111, 115 without including a housing or other enclosure for the battery 130. In an exemplary embodiment, the tool portion housing 111, 115 and/or the battery 130 may comprise a release for releasing the battery 130 from its secure connection to the electrical connections on the tool portion housing 111, 115. The release may be a button, tab, or any suitable mechanism for engaging and disengaging the battery 130 with the tool portion housing 111, 115.

The handle portion 120 may comprise a grip 121, a handle pivot 122, and a user input control 123. The grip 121 may have a first end and a second end. The handle pivot 122 may be coupled to the first end of the grip 121 and the user input control 123 may be coupled to the second end of the grip 121, for example. The grip 121 may be a curved portion (e.g., generally banana-shaped) extending from the handle connection base 112 of the tool portion 110 forward toward the nozzle 114 of the tool portion 110. The grip 121 may comprise an elastomer or any suitable material arranged over a hard plastic base, or any suitable material, to provide a comfortable, non-slip surface for grasping by a user.

The handle connection base 112 of the tool portion 110 may be pivotally coupled to the grip 121 at the handle pivot 122. For example, the tool portion 110 may be pivotable up and down as shown by exemplary tool portion positions 140, 150. The pivotability of the tool portion 110 with respect to the handle portion 120 provides enhanced efficacy of the handheld air movement apparatus 100. For example, directional height adjustments provided by the handle pivot 122 allow the nozzle 114 of the tool portion 110 to be positioned adjacent to its target, providing enhanced performance of the apparatus 100 based on the close proximity of the air flow source to the target. Additionally and/or alternatively, the pivotability of the tool portion 110 with respect to the handle portion 120 provides enhanced comfort to the user of the handheld air movement apparatus 100. For example, irrespective of the directional height adjustments provided by the handle pivot 122 to allow the nozzle 114 of the tool portion 110 to be positioned adjacent to its target, the position of the handle portion may remain constant in a natural grip position of the user. In various embodiments, the handle portion 120 maintained in the natural grip position of the user provides a proper weight distribution of the handheld air movement apparatus 100. Various embodiments enable a user to maintain a natural grip position at the handle portion 120 with a proper weight distribution of the apparatus 100 while maneuvering the tool portion 110 to a desired position 140, 150.

The handle pivot 122 may be and/or include one or more mechanisms for securing and releasing the handle connection base 112 of the tool portion 110 to the grip 121 of the handle portion 120. The handle pivot 122 and/or an associated rotation release mechanism 126 may be a spring loaded mechanism or any suitable mechanism for (1) releasing the handle connection base 112 of the tool portion 110 to allow the tool portion to pivot up and/or down with respect to the handle portion 120, and (2) locking the handle connection base 112 of the tool portion 110 in a locked position after selection of a tool portion 110 position and/or orientation. For example, the handle pivot 122 may have one or more buttons 126 that are depressed to allow the handle connection base 112 of the tool portion 110 to pivot. In various embodiments, the handle pivot 122 may include detents to provide pre-defined positions 140, 150. The one or more buttons 126, once released, may lock the tool portion 110 in the position 140, 150 at the time of the button release. As an example, the buttons 126 may include or be directly or indirectly coupled with protrusions that may extend into detents corresponding with pre-defined tool portion 110 positions 140, 150. Although two tool portion 110 positions 140, 150 are shown in FIGS. 1 and 2, any number of positions greater than or equal to two is contemplated.

In various embodiments, the tool portion 110 may be pivoted with respect to the handle portion 120 at the handle pivot from 0 degrees as shown in FIG. 1 to 45 degrees as shown in FIG. 2. Although two tool portion 110 positions 140, 150 are shown in FIGS. 1 and 2, any number of positions between and including the two positions 140, 150 is contemplated. For example, the handle pivot 122 may include pre-defined positions 140, 150 at 0 degrees, 15 degrees, 30 degrees, and/or 45 degrees. As another example, the handle pivot 122 may include pre-defined positions 140, 150 at 0 degrees, 10 degrees, 20 degrees, 30 degrees, and/or 40 degrees. Although various tool portion 110 positions 140, 150 are discussed above, any suitable positions 140, 150 are contemplated. In certain embodiments, any suitable position 140, 150 between and/or including 0 degrees 150 and 45 degrees 140 may be dynamically selected. For example, the handle pivot 122 may include a protrusion for press fitting the handle connection base 112 of the tool portion 110 to the grip 121 of the handle portion 120 in a dynamically selectable location within a predefined range, such as from 0 to 40 degrees, from 0 to 45 degrees, or any suitable range.

The user input control 123 may be coupled to and/or integrated with the grip 121 at the second end of the grip 121, for example. The user input control may comprise a trigger 124. The trigger 124 may extend from one or more of the user input control 123 or the 121. The trigger 124 is configured to start an air movement action by the tool portion 110 when the trigger 124 is depressed and to stop the air movement action when the trigger 124 is released. The trigger 124, for example, may be coupled by electrical wires to the tool portion 110. The electrical wires may run through a hollow portion of the handle portion 120. In various embodiments, the hollow portion of the handle portion 120 may include sheathing to protect the wiring. In an exemplary embodiment, the user input control 123 may include a boost button 125 for providing increased air movement over the normal operating condition of the tool portion 110. The boost button 125 may be coupled to the tool portion 110 by electrical wires that run through the hollow portion of the handle portion 120 with the trigger 124 electrical wires.

In various embodiments, the handheld air movement apparatus 100 having ergonomic gripping mechanisms 120 provides a natural grip orientation that affords anthropometric advantage over existing handheld air movement apparatus grips by providing a more natural grip position and improved weight distribution. For example, the ability of the tool portion 110 to pivot with respect to the handle portion 120 provides a more natural gripping position compared with fixed handles of typical handheld air movement apparatuses that are maneuvered to direct the nozzle of the tool by twisting a user's wrist and/or otherwise raising and lowering the apparatus. Moreover, the adjustability of the tool portion position 140, 150 improves the performance of the apparatus 100 by allowing the nozzle 114 to be placed closer to a target (e.g., leaves or grass trimmings at ground level or cobwebs in bushes at chest level). More specifically, the closer the nozzle 114 of the apparatus 100 is to its target, the more force or suction is received at the target.

Aspects of the present disclosure provide a handheld air movement apparatus 100. The apparatus 100 may comprise a handle portion 120 and a tool portion 110. The handle portion 120 may comprise a grip 121, a user input control 123, and a handle pivot 122. The grip 121 may include a first end and a second end. The user input control 123 may be positioned toward the first end of the grip 121. The handle pivot 122 may be positioned toward the second end of the grip 121. The tool portion 110 may comprise a housing 111, 115, a nozzle 114, and a handle connection base 112. The nozzle 114 may be coupled to the housing 111, 115. The tool portion 110 may provide air movement one or both of into or out of the nozzle 114 in response to a signal received from the user input control 123 of the handle portion 120. The handle connection base 112 of the tool portion 110 may be pivotally coupled to the handle portion 120 at the handle pivot 122 to provide directional height adjustment of the tool portion 110 with respect to the handle portion 120.

In a representative embodiment, the directional height adjustment of the tool portion 110 with respect to the handle portion 120 may be provided at a plurality of pre-defined angular positions 140, 150. In various embodiments, the plurality of pre-defined angular positions 140, 150 may include 0 degrees 150 and 45 degrees 140. In certain embodiments, the plurality of pre-defined angular positions 140, 150, may include at least one angular position between 0 degrees 150 and 45 degrees 140. In a representative embodiment, the plurality of pre-defined angular positions 140, 150 may include 0 degrees 150 and 40 degrees. In various embodiments, the plurality of pre-defined angular positions 140, 150 may include at least one angular position between 0 degrees 150 and 40 degrees.

In certain embodiments, the directional height adjustment of the tool portion 110 with respect to the handle portion 120 may be dynamically selectable within a pre-defined range 140, 150. In various embodiments, the pre-defined range 140, 150 may be from 0 degrees 150 to 45 degrees 140. In a representative embodiment, the pre-defined range 140, 150 may be from 0 degrees 150 to 40 degrees.

In various embodiments, the handle pivot 122 may comprise a spring loaded mechanism configured to release the handle connection base 112 of the tool portion 110 to allow the tool portion 110 to pivot one or both of up and down with respect to the handle portion 120. In certain embodiments, the handle pivot 122 may comprise a spring loaded mechanism configured to lock the handle connection base 112 of the tool portion 110 in a locked position after a selection of a tool portion position 140, 150. In a representative embodiment, the handle pivot 122 may comprise one or more buttons 126 configured to enable the handle connection base 112 of the tool portion 110 to pivot if depressed. In various embodiments, the handle pivot 122 may comprise a plurality of detents, each of the detents corresponding with one of the plurality of pre-defined angular positions 140, 150.

In a representative embodiment, the housing 111, 115 may comprise an upper portion 111 and a lower portion 115. The lower portion 115 may be coupled to the nozzle 114 at a first end and the upper portion 111 at the second end. The lower portion 115 may be tapered such that the first end of the lower portion 115 has a first diameter that is less than a second diameter of the second end of the lower portion 115. In certain embodiments, the housing 111, 115 may comprise an upper portion 111 and a lower portion 115. The upper portion 111 may comprise a first end, a second end, a top side, and an underside. The first end of the upper portion 111 may be coupled to the lower portion 115. The second end of the upper portion 111 may comprise a fan opening 113. In various embodiments, the top side of the upper portion 111 comprises the handle connection base 112.

In certain embodiments, the top side of the upper portion 111 may comprise electrical connections configured to receive a battery 130 configured to power the handheld air movement apparatus 100. In various embodiments, the grip 121 may comprise a banana-shaped curved portion between the first end and the second end. In a representative embodiment, the user input control 123 comprises a trigger 124 configured to provide a first amount of the air movement. In certain embodiments, the user input control 123 may comprise a boost button 125 configured to provide a second amount of the air movement, and wherein the second amount of the air movement is greater than the first amount of the air movement.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As used herein, the terms "exemplary" and "example" mean serving as a non-limiting example, instance, or illustration. As used herein, the term "e.g." and "for example" set off lists of one or more non-limiting examples, instances, or illustrations. As utilized herein, a component is "operable" and/or "configured" to perform a function whenever the component is designed and comprises the necessary element (s) to perform the function, regardless of whether the function is performed and/or whether performance of the function is disabled, or not enabled, by some user-configurable setting.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment or embodiments disclosed, but that the present disclosure will include all embodiments falling within the scope of the appended claims.

What is claimed is:

1. A handheld air movement apparatus comprising:

a handle portion comprising:

a grip having a first end and a second end, and a handle pivot positioned toward the second end of the grip, wherein the handle pivot comprises a spring loaded mechanism; and a tool portion comprising:

a housing, a nozzle coupled to the housing, and a handle connection base pivotally coupled to the handle portion at the handle pivot, wherein the spring loaded mechanism of the handle pivot is configured to release the handle connection base of the tool portion to allow the tool portion to pivot one or both of up and down with respect to the handle portion to provide directional height adjustment of the tool portion with respect to the handle portion.

2. The handheld air movement apparatus of claim 1, wherein the directional height adjustment of the tool portion with respect to the handle portion is provided at a plurality of pre-defined angular positions.

3. The handheld air movement apparatus of claim 2, wherein the plurality of pre-defined angular positions include 0 degrees and 45 degrees.

4. The handheld air movement apparatus of claim 3, wherein the plurality of pre-defined angular positions include at least one angular position between 0 degrees and 45 degrees.

5. The handheld air movement apparatus of claim 2, wherein the plurality of pre-defined angular positions include 0 degrees and 40 degrees.

6. The handheld air movement apparatus of claim 5, wherein the plurality of pre-defined angular positions include at least one angular position between 0 degrees and 40 degrees.

7. The handheld air movement apparatus of claim 2, wherein the handle pivot comprises a plurality of detents, each of the detents corresponding with one of the plurality of pre-defined angular positions.

8. The handheld air movement apparatus of claim 1, wherein the directional height adjustment of the tool portion with respect to the handle portion is dynamically selectable within a pre-defined range.

9. The handheld air movement apparatus of claim 8, wherein the pre-defined range is from 0 degrees to 45 degrees.

10. The handheld air movement apparatus of claim 8, wherein the pre-defined range is from 0 degrees to 40 degrees.

11. The handheld air movement apparatus of claim 1, wherein the spring loaded mechanism is configured to lock the handle connection base of the tool portion in a locked position after a selection of a tool portion position.

12. The handheld air movement apparatus of claim 1, wherein the handle pivot comprises one or more buttons configured to enable the handle connection base of the tool portion to pivot if depressed.

13. The handheld air movement apparatus of claim 1, wherein:

the housing comprises an upper portion and a lower portion, the lower portion is coupled to the nozzle at a first end and the upper portion at the second end, and the lower portion is tapered such that the first end of the lower portion has a first diameter that is less than a second diameter of the second end of the lower portion.

14. The handheld air movement apparatus of claim 1, wherein:

the housing comprises an upper portion and a lower portion, the upper portion comprises a first end, a second end, a top side, and an underside, the first end of the upper portion is coupled to the lower portion, and the second end of the upper portion comprises a fan opening.

15. The handheld air movement apparatus of claim 14, wherein the top side of the upper portion comprises the handle connection base.

16. The handheld air movement apparatus of claim 14, wherein the top side of the upper portion comprises electrical connections configured to receive a battery configured to power the handheld air movement apparatus.

17. The handheld air movement apparatus of claim 1, wherein the grip comprises a banana-shaped curved portion between the first end and the second end.

18. The handheld air movement apparatus of claim 1, comprising a trigger positioned toward the first end of the grip, wherein the trigger is configured to control a first amount of air movement one or both of into or out of the nozzle of the tool portion.

19. The handheld air movement apparatus of claim 18, comprising a boost button positioned toward the first end of the grip, wherein the boost button is configured to control a second amount of the air movement, and wherein the second amount of the air movement is greater than the first amount of the air movement.

* * * * *